US007681556B2

(12) United States Patent
Hwang

(10) Patent No.: US 7,681,556 B2
(45) Date of Patent: Mar. 23, 2010

(54) FUEL SUPPLY SYSTEM FOR USE IN HEAVY CONSTRUCTION/FOREST EQUIPMENT AND SECONDARY FUEL TANKS THEREOF

(75) Inventor: Soo Bong Hwang, Gimhae-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 406 days.

(21) Appl. No.: 11/805,965

(22) Filed: May 25, 2007

(65) Prior Publication Data

US 2008/0000916 A1 Jan. 3, 2008

(30) Foreign Application Priority Data

Jun. 28, 2006 (KR) ..... 10-2006-0058644

(51) Int. Cl.
*F02M 37/00* (2006.01)

(52) U.S. Cl. ..... 123/510; 123/514

(58) Field of Classification Search ..... 123/509, 123/510, 511, 514, 516; 220/562; 280/831
See application file for complete search history.

(56) References Cited

U.S. PATENT DOCUMENTS

| | | | | | |
|---|---|---|---|---|---|
| 4,149,733 | A | | 4/1979 | Grooss | |
| 4,620,568 | A | * | 11/1986 | Sumerford et al. | 137/899.4 |
| 4,874,013 | A | * | 10/1989 | Hack, Jr. | 137/571 |
| 5,016,721 | A | * | 5/1991 | Yamamoto et al. | 180/89.13 |
| 5,085,198 | A | * | 2/1992 | Bartlett et al. | 123/510 |
| 5,197,443 | A | * | 3/1993 | Hodgkins | 123/514 |
| 5,360,034 | A | * | 11/1994 | Der Manuelian | 137/571 |
| 5,845,940 | A | * | 12/1998 | Colburn | 280/830 |
| 5,983,932 | A | * | 11/1999 | Wagner et al. | 137/587 |
| 6,089,252 | A | * | 7/2000 | Braun | 137/263 |
| 6,135,426 | A | * | 10/2000 | Wargolet et al. | 261/18.3 |
| 6,550,811 | B1 | | 4/2003 | Bennett et al. | |
| 6,637,706 | B2 | * | 10/2003 | Kim et al. | 248/154 |
| 6,745,860 | B2 | * | 6/2004 | Yabe | 180/68.1 |
| 6,938,928 | B2 | * | 9/2005 | Pfohl et al. | 280/831 |
| 7,338,114 | B2 | * | 3/2008 | Ishii et al. | 296/190.05 |
| 2003/0056824 | A1 | * | 3/2003 | Harvey | 137/265 |
| 2006/0086389 | A1 | | 4/2006 | Erickson et al. | |

FOREIGN PATENT DOCUMENTS

| | | |
|---|---|---|
| DE | 102 08 425 A1 | 10/2002 |
| EP | 0 915 250 A1 | 5/1999 |
| JP | 1999245676 | 9/1999 |
| JP | 2000144811 | 5/2000 |
| JP | 2003326989 | 11/2003 |

* cited by examiner

*Primary Examiner*—Thomas N Moulis
(74) *Attorney, Agent, or Firm*—Ladas and Parry LLP

(57) ABSTRACT

A fuel supply system for supplying a fuel to an engine mounted on an upper frame of heavy construction/forest equipment is provided. The fuel supply system includes a junction tank unit for interflowing a fuel supply line which is connected to a lower end of a primary fuel tank and a fuel supply line which is connected to a lower end of a secondary fuel tank, the fuel supply lines being connected in parallel to each other, a water separator connected to the junction tank unit via a fuel supply line, a fuel supply line for supplying the fuel to an engine from the water separator, and a fuel recovery line for recovering a remaining fuel from the engine to the primary fuel tank.

7 Claims, 8 Drawing Sheets

FUEL SUPPLY SYSTEM FOR USE IN HEAVY CONSTRUCTION/FOREST EQUIPMENT AND SECONDARY FUEL TANKS THEREOF

CROSS-REFERENCE TO RELATED APPLICATION

This application is based on and claims priority from Korean Patent Application No. 10-2006-58644, filed on Jun. 28, 2006 in the Korean Intellectual Property Office, the disclosure of which is incorporated herein in its entirety by reference.

BACKGROUND OF THE INVENTION

1. Field of the invention

The present invention relates to a fuel supply system for use in heavy construction/forest equipment and a secondary fuel tank thereof, by which the heavy construction equipment, such as an excavator, driven at a spot where the supply of fuel is difficult or cumbersome or the forest equipment consuming a lot of fuel can effectively carry out the operation with the aid of the secondary fuel tank that is additionally installed in the equipment.

2. Description of the Prior Art

Heavy construction equipment is generally designed to have a capacity of a fuel tank on the standard of one day (about 16 hours). In case of the conventional heavy construction equipment, therefore, the capacity of the fuel tank determines the whole capacity of the fuel tank of the equipment. Existing excavators have an insufficient capacity of a fuel tank to supply the fuel required for a daily operation of heavy workload. An operator always carries a portable fuel tank filled with a fuel so as to prevent a fuel failure in supply. However, it is not a great help to the operator. That is, if the equipment runs short of fuels, the operator has to stop working so as to supply the fuel.

In case of up-countries or rugged sites, since it is difficult for a fuel supply vehicle to access the sites, the excavator should move to the place where the fuel can be supplied. After refueling, the excavator moves to the site. It causes not only the time loss, but the loss of efficiency, since the fuel is supplied during the work.

The conventional equipment includes a fuel line of series construction in which the fuel is fed from an existing fuel tank to an engine and the remaining fuel is returned to the fuel tank from the engine. In order to solve the above problem, Korean Patent No. 7055 discloses a fuel tank including an auxiliary fuel which is connected in series to a primary tank via a tube, by which the fuel is pumped from the auxiliary tank to the primary tank by a fuel supply pump. Since the auxiliary fuel tank is installed on a chassis portion of a lower driving structure, the tube should be detached from the auxiliary fuel tank after the fuel is fed to the primary fuel tank mounted on an upper swing structure. In addition, the capacity of the auxiliary fuel tank is not sufficient.

SUMMARY OF THE INVENTION

Accordingly, the present invention has been made to solve the above-mentioned problems occurring in the prior art while advantages achieved by the prior art are maintained intact.

One object of the present invention is to provide a fuel supply system including a secondary fuel tank which is mounted on an extended portion of a counterweight mounting member of an upper frame.

Another object of the present invention is to provide a fuel supply system including a secondary fuel tank connected in parallel to a primary fuel tank and a junction tank installed on a lower portion of the secondary fuel tank, thereby maintaining a fuel level constantly when heavy equipment is inclined, and thus preventing bubbles from being introduced into the fuel tank together with the fuel if the fuel tank is inclined or rolls heavily.

Still another object of the present invention is to provide a fuel supply system including a secondary fuel tank, by which heavy equipment of high rate of capacity use can carry out work during two to three days by once fuel supply.

In order to accomplish these objects, there is provided a fuel supply system for supplying a fuel to an engine mounted on an upper frame of heavy construction/forest equipment, the fuel supply system comprising: a junction tank unit for interflowing a fuel supply line which is connected to a lower end of a primary fuel tank and a fuel supply line which is connected to a lower end of a secondary fuel tank, the fuel supply lines being connected in parallel to each other; a water separator connected to the junction tank unit via a fuel supply line; a fuel supply line for supplying the fuel to an engine from the water separator; and a fuel recovery line for recovering a remaining fuel from the engine to the primary fuel tank.

The existing heavy construction equipment or forest equipment includes only one fuel tank to perform the work. The present invention includes another fuel tank having a capacity larger than that of the existing fuel tank. Herein, the existing tank is called as a primary fuel tank, while another fuel tank is called as a secondary fuel tank.

A swing frame of the excavator is generally called as an upper frame, and the primary fuel tank is mounted on the upper frame. A counterweight is installed on a rear portion of the upper frame opposite to a front portion, on which a bucket is mounted, in order to maintain the balance thereof when the equipment lifts an object. As a result, it prevents the equipment from leaning to the front portion.

The counterweight is installed on the rear portion of the upper frame opposite to the front portion, on which the bucket is mounted, thereby maintaining seesaw motion. The beam of the upper frame is extended, and the counterweight is mounted on the extended beam.

The secondary fuel tank is installed on a counterweight mounting member extended from the upper frame at a certain distance, in which the secondary fuel tank and a counterweight are sequentially installed on the mounting member. The above construction contributes to reduce the weight of the counterweight. Since the fuel tanks have a certain load and the counterweight is positioned at a relative rear position, the moment is increased. As a result, although the load of the counterweight is reduced, it does not matter in the work capacity of the equipment.

Also, a capacity of the secondary fuel tank is twice as large as a capacity of the primary fuel tank. In case that the capacity is excessively large, its own weight is increased, thereby lowering the efficiency of the equipment. In addition, since there is a problem in that a space of the upper frame is not sufficient, twice capacity is preferable.

Since the secondary fuel tank is mounted on the upper frame together with the primary fuel tank, the fuel tanks have the same level. occasionally, there may be a difference in the level of the fuel tanks. In order to solve the level difference, the junction tank unit is installed in such a way that the junction level is positioned at a position lower than the fuel tanks. Since the junction tank unit is positioned at a position lower than the fuel tanks, a junction tank is filled with the fuel. Also, since the primary fuel tank is connected in parallel to the secondary fuel tank, the pressure at the junction level is equal, so that the levels of the fuels are identical. The junction tank prevents that, when the equipment travels on an inclined ground, the fuel tanks are inclined, and thus the fuel is gathered in one fuel tank, so that air is introduced in the fuel supply line. Also, due to the position of the junction tank unit, the fuel is smoothly supplied even though the equipment is working on the inclined ground.

The junction tank unit is positioned at a level lower than a bottom surface of the primary fuel tank or secondary fuel tank, thereby preventing introduction of air. When the equipment travels on the steep inclined ground, the primary fuel tank is positioned at a level higher than the secondary fuel tank, so that the fuel may be gathered in the secondary fuel tank, or the secondary fuel tank is positioned at a level higher than the primary fuel tank, so that the fuel may be gathered in the primary fuel tank. In this instance, it is preferable that the junction tank is mounted on the extended counterweight mounting member of the secondary fuel tank, so as to steadily supply the fuel to the excavator.

The junction tank unit includes a junction tank, an upper connector directly connected to an upper portion of the junction tank, in which the fuel supply line of the primary fuel tank is connected in parallel to the fuel supply line of the secondary fuel tank, a strainer installed in a center portion of the junction tank for filtering impurities, a cylindrical drain box installed on a center lower end of the junction tank and positioned at a level lower than an internal bottom surface of the junction tank, and a drain plug and a lower connector each provided on a bottom surface of the drain box, the lower connector being connected to the strainer and an external fuel supply line.

An upper connector is provided on the upper portion of the junction tank, and is directly connected to the junction tank. The upper connector is connected in parallel with the primary fuel tank and the secondary fuel tank. The upper connector is formed in a rectangular box, and has connecting portions provided on two sides thereof. The fuel lines of the primary and secondary fuel tanks are respectively connected to the connecting portions of the upper connector. A maintenance valve, for example, a ball valve, may be installed in the fuel lines of the primary and secondary fuel tanks in front of the upper connector, in order to maintain the upper connector, if necessary. Also, the primary fuel tank or the secondary fuel tank is selectively connected to the junction tank by means of the valve, if necessary. The upper connector is connected to the fuel liens by means of a union.

The fuel passing through the upper connector is gathered in the junction tank. Since the junction tank is positioned at a level lower than two fuel tanks, the junction tank is always filled with the fuel. A strainer for filtering impurities is mounted in the interior of the junction tank in front of a fuel line connected to the engine. A mesh of the strainer is determined by the viscosity of the fuel. A drain box is installed on the lower end of the tank, so that impurities are settled down on the bottom surface of the drain box, except for floating impurities.

A lower connector is installed on an external outer end of the drain box from the strainer via the drain box. The lower connector is connected to the water separator. After moistures are eliminated from the fuel by the water separator, the fuel is fed to the engine via the fuel supply line. The remaining fuel which is not used in the engine is returned to the fuel tank from the engine via the recovery line.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
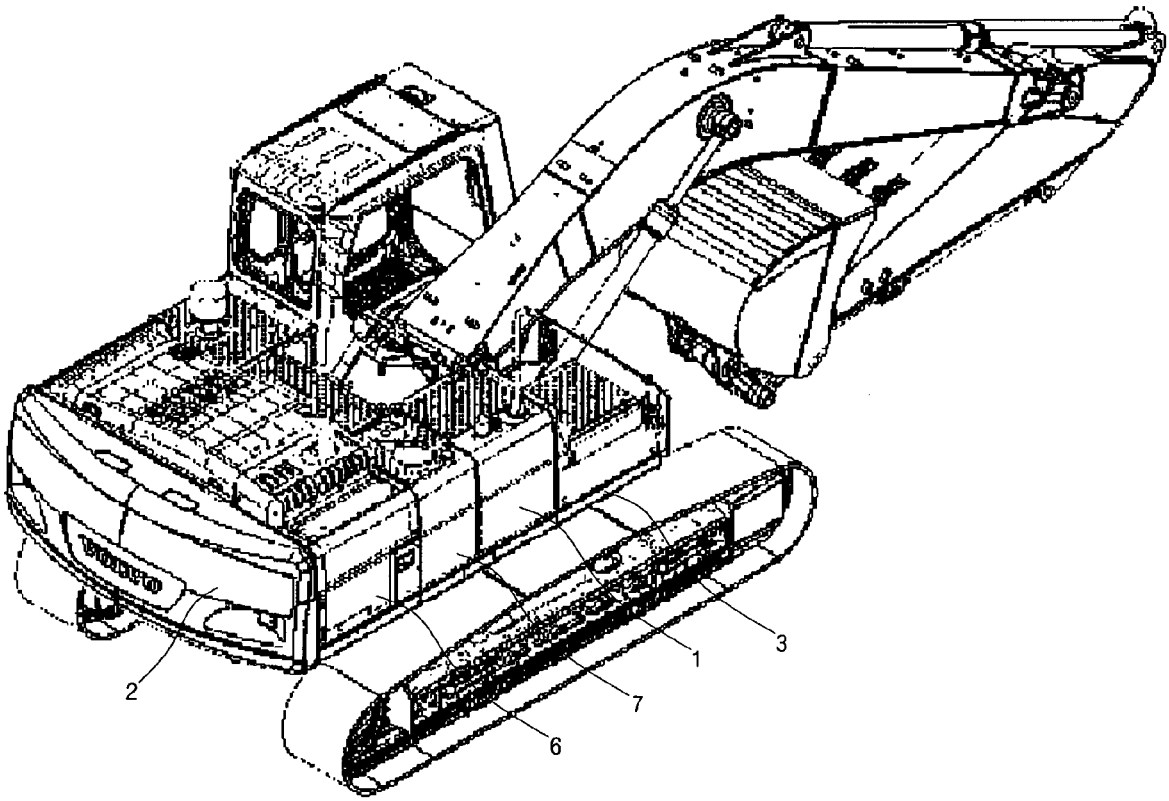
Fig. 1 Prior Art
FIG. 1 is a perspective view of conventional heavy construction equipment.

FIG. 1 is a perspective view of conventional heavy construction equipment, for example, an excavator. Referring to FIG. 1, a fuel tank 1 is mounted on a right side of an upper frame 3, and a hydraulic fluid tank 7 is mounted on a left side of the fuel tank 1. Also, a side door 6 is mounted on a left side of the hydraulic fluid tank 7, and a counterweight 2 is installed on a rear portion of the upper frame 3.

Figure 2:
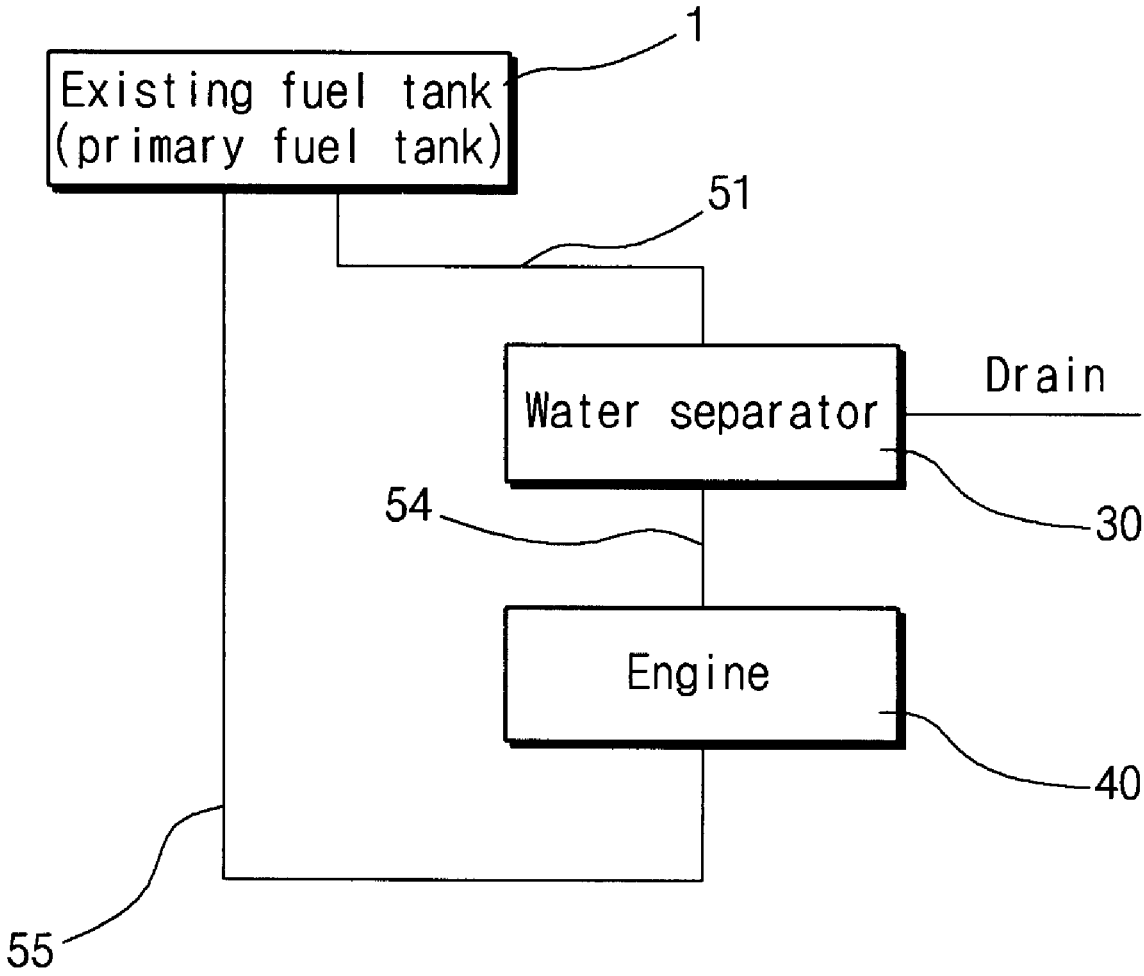
Fig. 2 Prior Art
FIG. 2 is a view of a conventional fuel supply system.

FIG. 2 is a view of a conventional fuel supply system. The fuel supply system includes a water separator 30 connected to the fuel tank 1 via a fuel supply line 51. After moistures are eliminated from the fuel by the water separator, the fuel is fed to an engine 40 via a fuel supply line 54. The remaining fuel is returned to the fuel tank 1 from the engine via a recovery line 55.

Figure 3:
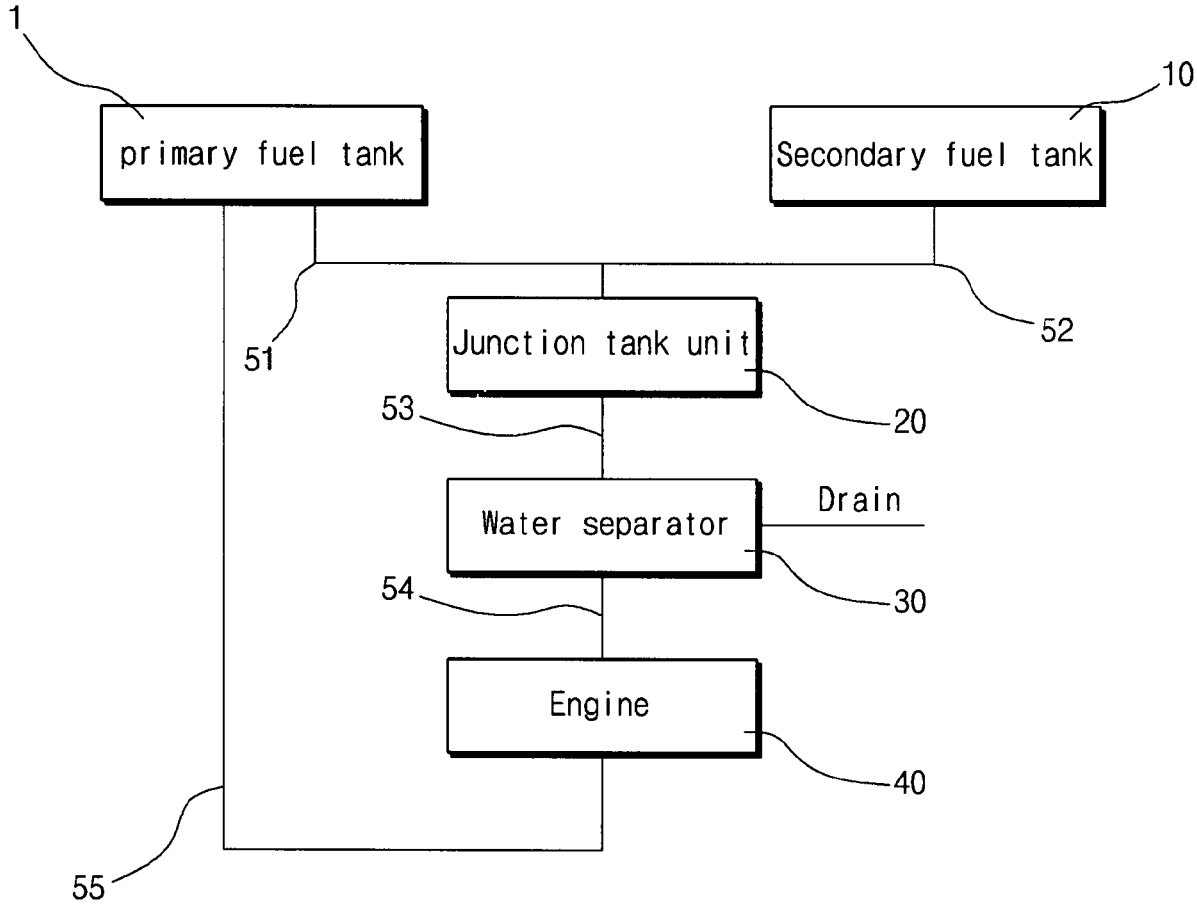
FIG. 3 is a view of a fuel supply system according to the present invention.

FIG. 3 is a view of a fuel supply system according to the present invention. As can be seen from FIG. 3, a primary fuel tank 1, is connected in parallel to a secondary fuel tank 10 via fuel supply lines 51 and 52. The fuel supply lines 51 and 52 are joined by a junction tank unit 20. The fuel interflowed at the junction tank unit 20 is fed to the water separator 30 through a fuel supply line 53. The water separator 30 eliminates the moistures from the fuel by using a specific gravity difference between water and fuel, in which the separated fuel is fed to the engine 40 via a fuel supply line 54. The remaining fuel is returned to the primary fuel tank via a recovery line 55.

Figure 4:
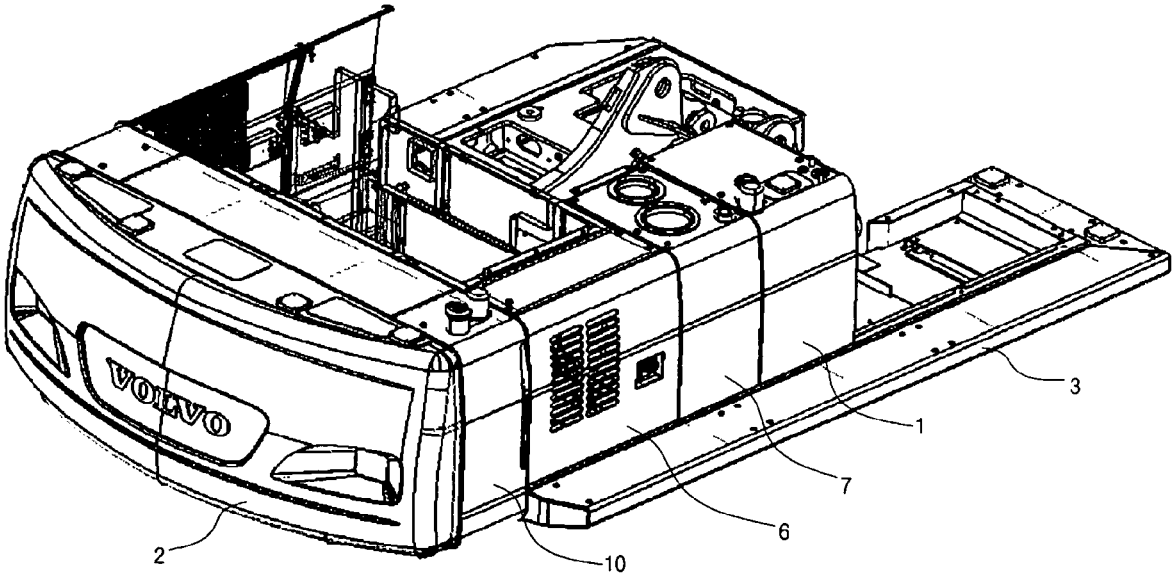
FIG. 4 is a perspective view illustrating a secondary fuel tank according to the present invention.

FIG. 4 is a perspective view illustrating the secondary fuel tank according to the present invention. Supposing a bucket mount side is a front side, the primary fuel tank 1 is mounted on a right side of the front portion on an upper frame 3, and a hydraulic fluid tank 7 is mounted on the right side of the primary fuel tank 1. A side door 6 is mounted on the left side of the hydraulic fluid tank 7, and the secondary fuel tank 10 is mounted on the left side of the side door. A counterweight 2 is mounted on the rear portion of the secondary fuel tank. A level of the fuel contained in the secondary fuel tank can be known through a level gauge between the side door 6 and the secondary fuel tank.

Figure 5:
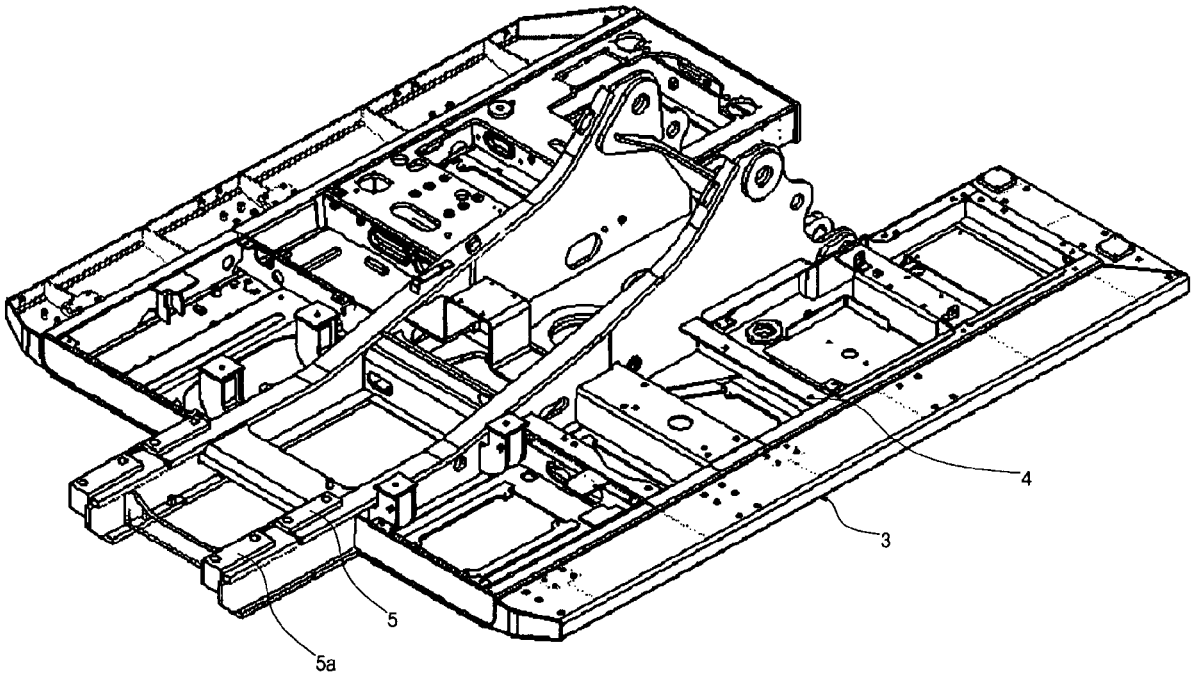
FIG. 5 is a perspective view illustrating the upper frame in FIG. 4.

FIG. 5 is a perspective view illustrating the upper frame 3 in FIG. 4, in which the primary fuel tank is mounted on a frame 4, the secondary fuel tank is mounted on a frame 5, and a the counterweight is mounted on a frame 5*a*. Although the mounting member 5 is a mounting member of the counterweight in the existing upper frame 3, the counterweight is mounted on an extended portion 5*a* of the mounting member 5.

Figure 6A:
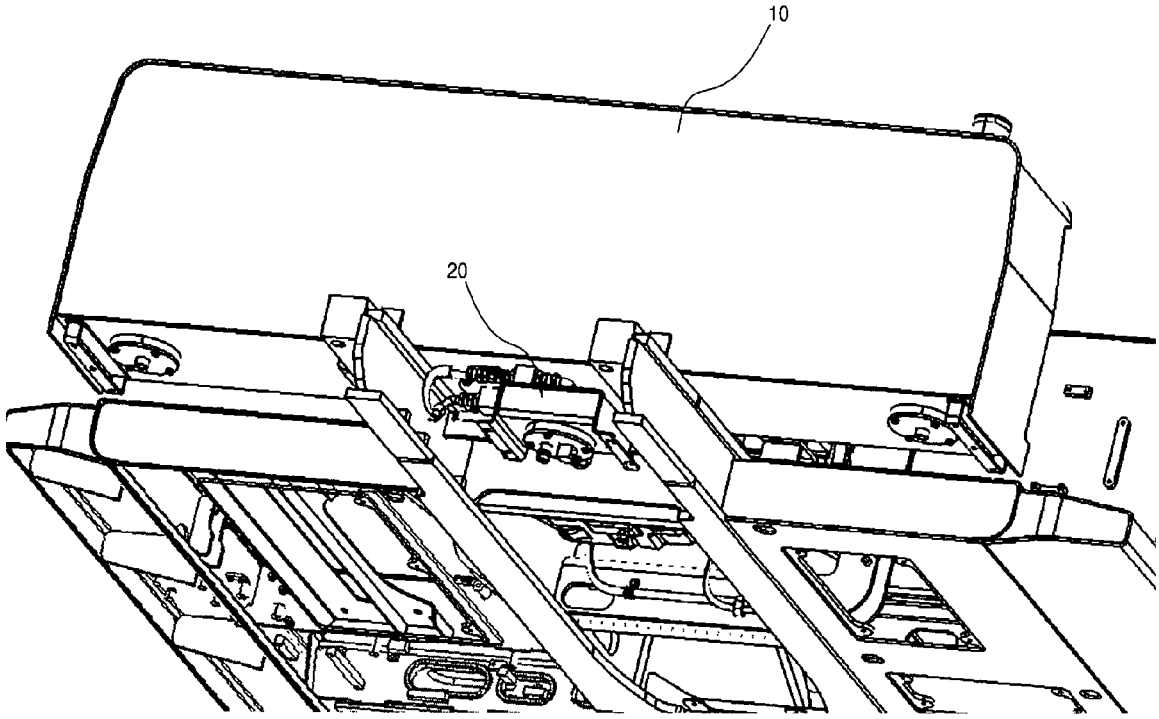
FIG. 6*a* is a perspective view of a secondary fuel tank in bottom view.

FIG. 6*a* is a perspective view of the secondary fuel tank in bottom view, and illustrates the secondary fuel tank 10 and the junction tank unit 20 positioned under the secondary fuel tank 10.

Figure 6B:
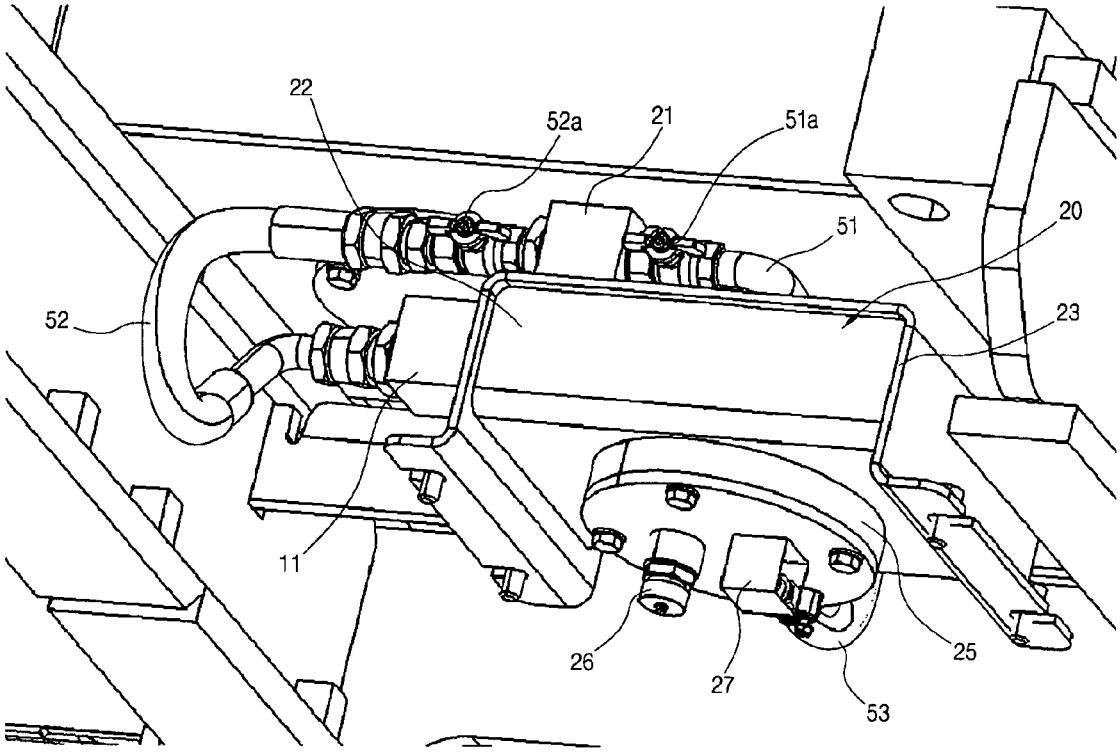
FIG. 6*b* is a partially enlarged view illustrating a junction tank unit positioned under a secondary fuel tank.

FIG. 6*b* is a partially enlarged view illustrating the junction tank unit 20 positioned under the secondary fuel tank. The hydraulic fuel is fed to an upper connector 21 through the fuel supply line 52 from a discharge box 11 which is directly connected to the lower portion of the secondary fuel tank. Since the discharge box 11 is positioned under the secondary fuel tank, air is not absorbed in the fuel. Also, since the junction tank unit 20 is positioned under the secondary fuel tank 10, the air is not absorbed in the fuel. As a result, there is an advantage of reducing the possibility in that the junction tank unit absorbs liquid or air, besides the fuel. The connector is easily connected by use of a union.

Valves may be mounted on the connected portions between the fuel supply lines 51 and 52 and the upper connector 21 so as to perform the maintenance. If the valves 51*a* and 52*a* are mounted, the fuel supply is interrupted by use of the valves, for example, in case that a strainer installed in the junction tank unit 20 is necessarily replaced. In addition, the user can selectively use the primary and secondary fuel tanks.

The fuel supply line 51 connected to the primary fuel tank and the fuel supply line 52 connected to the secondary fuel tank interflow in the upper connector 21. Since both fuel tanks interflow at one point, the pressures of both fuel tanks become equal to each other. That is, the primary fuel tank and the secondary fuel tank are connected in parallel with each other. A joint may be fastened to the upper connector 21 by means of a union.

The upper connector 21 is directly connected to the junction tank 22. The junction tank 22 is mounted on a junction tank holder 23 which is connected to the junction tank, and a center portion of the mounting member 5 of the secondary fuel tank. A drain box 25 is installed on a lower center portion of the junction tank, and a lower end of the drain box 25 is connected to a drain plug 26 and a lower connector 27 which is a mounting portion of the fuel supply line 53 connected to the water separator 30.

Figure 7A:
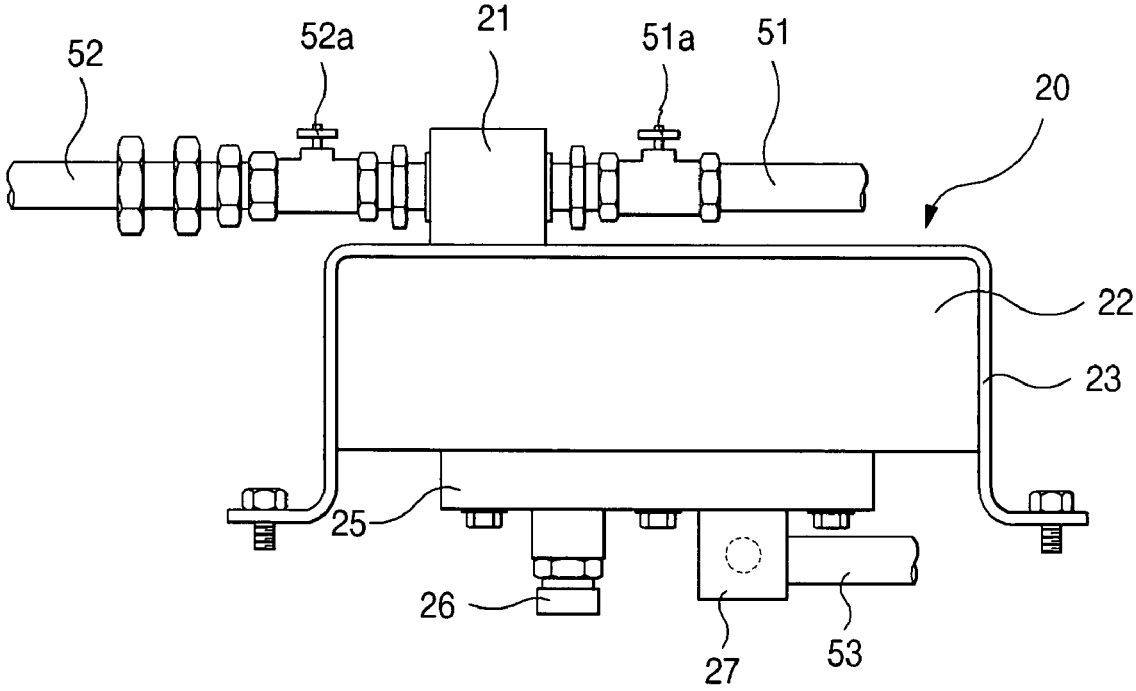
FIG. 7*a* is a front view of a junction tank unit.

FIG. 7*a* is a front view of the junction tank unit 20, and the construction thereof is substantially identical to that shown in FIG. 6*b*.

Figure 7B:
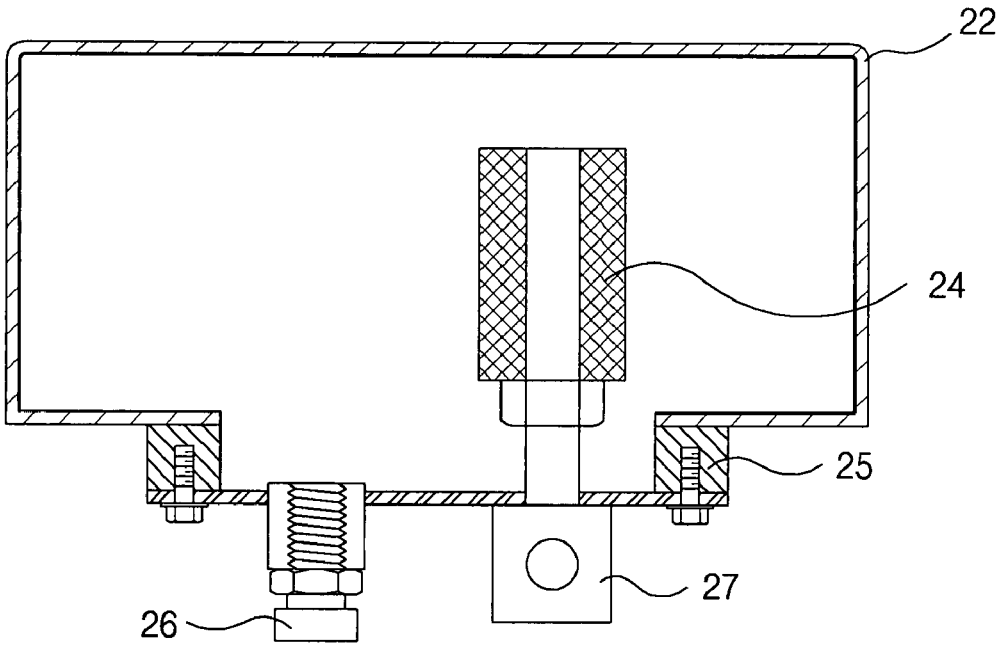
FIG. 7*b* is a cross-sectional view illustrating an interior of a junction tank.

FIG. 7*b* is a cross-sectional view illustrating an interior of the junction tank. The strainer 24 is mounted in the interior of the junction tank 22 to prevent impurities from flowing in the fuel supply line. The strainer 24 is connected to a short tube which is connected to the lower connector 27. The drain box 25 is connected to the lower portion of the strainer 24, and the lower portion of the drain box 25 is fastened to a plate by means of bolts. Impurities are settled down on the bottom surface of the drain box, except for floating impurities. The impurities settled down in the drain box 25 are drained by opening the drain plug 26, thereby eliminating the impurities.

Referring to FIG. 3, the fuel supply line 53 connected to the lower connector is connected to the water separator 30. After moistures are eliminated from the fuel by the water separator, the fuel is fed to the engine 40 via the fuel supply line 54. The remaining fuel which is not used in the engine is returned to the fuel tank 1 from the engine via the recovery line 55.

With the above description, since the heavy construction equipment can be driven during a long time by once fuel supply, the time loss required for the fuel supply is shortened, and thus the work efficiency is improved.

In case of the sites where the fuel supply is difficult, such as up-countries or rugged sites, since the equipment can be driven during a long time by once fuel supply, the efficiency of fuel supply is improved.

Also, the secondary fuel tank is mounted on the rear portion of the equipment. Therefore, since the weight of the rear portion of the equipment is increased, the whole stability of the equipment is improved.

Since the primary and secondary fuel tanks are connected in parallel to each other, the pressures of the fuel tanks are equal at the junction point. Therefore, the fuel is smoothly supplied, and if the equipment is positioned on the inclined ground, the air is not contained in the fuel tanks.

In case of the equipment requiring for the equal stability, since the weight of the secondary fuel tank is increased, the weight of the counterweight may be reduced. It can advantageously save a cost of the counterweight.

Also, in case of the heavy equipment, such as an excavator, the lifting capacity can be increased due to the load of the counterweight and fuel tanks.

In addition, the primary fuel tank and/or the secondary fuel tank can be selectively used by installing the valves at the junction points in which the upper connector of the junction tank interflows. Also, the maintenance hereof can be easily performed.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A fuel supply system for supplying a fuel to an engine mounted on an upper frame of heavy construction/forest equipment, the fuel supply system comprising:

a junction tank unit for interflowing a fuel supply line which is connected to a lower end of a primary fuel tank and a fuel supply line which is connected to a lower end of a secondary fuel tank, the fuel supply lines being connected in parallel to each other;

a water separator connected to the junction tank unit via a fuel supply line;

a fuel supply line for supplying the fuel to an engine from the water separator; and a fuel recovery line for recovering a remaining fuel from the engine to the primary fuel tank.

2. The fuel supply system as claimed in claim 1, wherein the secondary fuel tank is installed on a counterweight mounting member extended from the upper frame at a certain distance, in which the secondary fuel tank and a counterweight are sequentially installed on the mounting member.

3. The fuel supply system as claimed in claim 1, wherein a capacity of the secondary fuel tank is twice as large as a capacity of the primary fuel tank.

4. The fuel supply system as claimed in claim 1, wherein the junction tank unit is position at a level lower than a bottom surface of the primary fuel tank or secondary fuel tank.

5. The fuel supply system as claimed in claim 4, wherein the junction tank unit is installed on the counterweight mounting member extended from a lower portion of the secondary fuel tank.

6. The fuel supply system as claimed in claim 1, wherein the junction tank unit includes:

a junction tank;

an upper connector directly connected to an upper portion of the junction tank, in which the fuel supply line of the primary fuel tank is connected in parallel to the fuel supply line of the secondary fuel tank;

a strainer installed in a center portion of the junction tank for filtering impurities;

a cylindrical drain box installed on a center lower end of the junction tank and positioned at a level lower than an internal bottom surface of the junction tank; and a drain plug and a lower connector each provided on a bottom surface of the drain box, the lower connector being connected to the strainer and an external fuel supply line.

7. The fuel supply system as claimed in claim 6, wherein a valve is installed on the fuel supply line which is connected to the upper connector, so as to selectively the primary fuel tank and/or the secondary fuel tank.

* * * * *